US005271723A

United States Patent [19]

Hodge

[11] Patent Number: 5,271,723

[45] Date of Patent: Dec. 21, 1993

[54] ENGINE DRIVEN OIL PUMP

[75] Inventor: Steve Hodge, Wilnecote, Great Britain

[73] Assignee: Concentric Pumps Limited, Great Britain

[21] Appl. No.: 861,956

[22] Filed: Apr. 2, 1992

[30] Foreign Application Priority Data

Apr. 2, 1991 [GB] United Kingdom ..... 9106807

[51] Int. Cl.[5] ..... F04B 17/00

[52] U.S. Cl. ..... 417/364; 415/229; 384/300

[58] Field of Search ..... 417/359, 364; 415/229; 384/202, 298, 300

[56] References Cited

U.S. PATENT DOCUMENTS

| | | | |
|---|---|---|---|
| 1,955,383 | 4/1934 | Herman | 417/364 |
| 2,020,224 | 11/1935 | Waseige | 417/364 |
| 3,115,096 | 12/1963 | Wall | 417/359 |
| 3,211,483 | 10/1965 | Sullivan, Jr. | 384/202 |

*Primary Examiner*—Richard A. Bertsch
*Assistant Examiner*—Charles G. Freay
*Attorney, Agent, or Firm*—Learman & McCulloch

[57] ABSTRACT

Oil pump manufacture is simplified by providing the pump body with a planar unstepped face and achieving radial location by the provision of a bush 22 (FIG. 2) on the pump driven shaft 14, which bush is received in the counterbore 24 of the part journalling the drive shaft 16, i.e. the cylinder block adjacent the end of the drive shaft (crankshaft).

4 Claims, 1 Drawing Sheet

ENGINE DRIVEN OIL PUMP

TECHNICAL FIELD

This invention relates to oil pumps such as gerotor pumps primarily for i.c. engines.

BACKGROUND OF THE INVENTION

In a typical layout, the drive shaft for the pump—which may be the nose of the engine crankshaft—has a central splined or slotted bore to receive the splined or tang end or the driven shaft in the pump. This driven shaft projects through a pump body face, and that face mates with the engine block/sump and alignment is achieved by a circular formation or step machined in said face and a complementary step formation on the pump body. Radially outwardly of the step the face is apertured for securing bolts.

SUMMARY OF THE INVENTION

The object of the invention is to simplify manufacture.

According to the invention a pump of the kind described has a body with a planar unstepped face, and said driven shaft is journalled by a bush in a bore in the engine block or like, said bush projecting from said face and being used for pump alignment.

This eliminates one operation in machining the pump body.

Conveniently the bush is one coated with or impregnated with a low friction material such as PTFE which is effective in the bore of the bush in order to journal the driven shaft.

This driven shaft is usually a problem for lubrication, involving either a bleed of pumped lubricant or splash from the sump, both of which are unsatisfactory: thus the pumped lubricant is at this point (i.e. in the pump) unfiltered, because the lubricant circuit goes from pump to main filter and only then to points to be lubricated, so that if this bush is to be supplied with filtered lubricant, an extra delivery gallery is required duplicating the one from the pump to the filter, and simply returning a proportion to the pump shaft. That is considered to be an undesirable complication. The splash alternative primarily relies upon oil mist in the sump reaching the shaft, and is found in practice to be unreliable.

PTFE impregnated bush has been known per se for very many years but has never been used for this purpose, as far as is known to the inventor. The use is surprising and non-obvious. The combination of solving the lubrication problem for the oil pump driven shaft and use of the same bush to simplify pump body machining by providing location in use is an important advantage for the invention.

The invention is now more particularly described with reference to the accompanying drawings wherein:

THE DRAWINGS

THE PREFERRED EMBODIMENT

Figure 1:
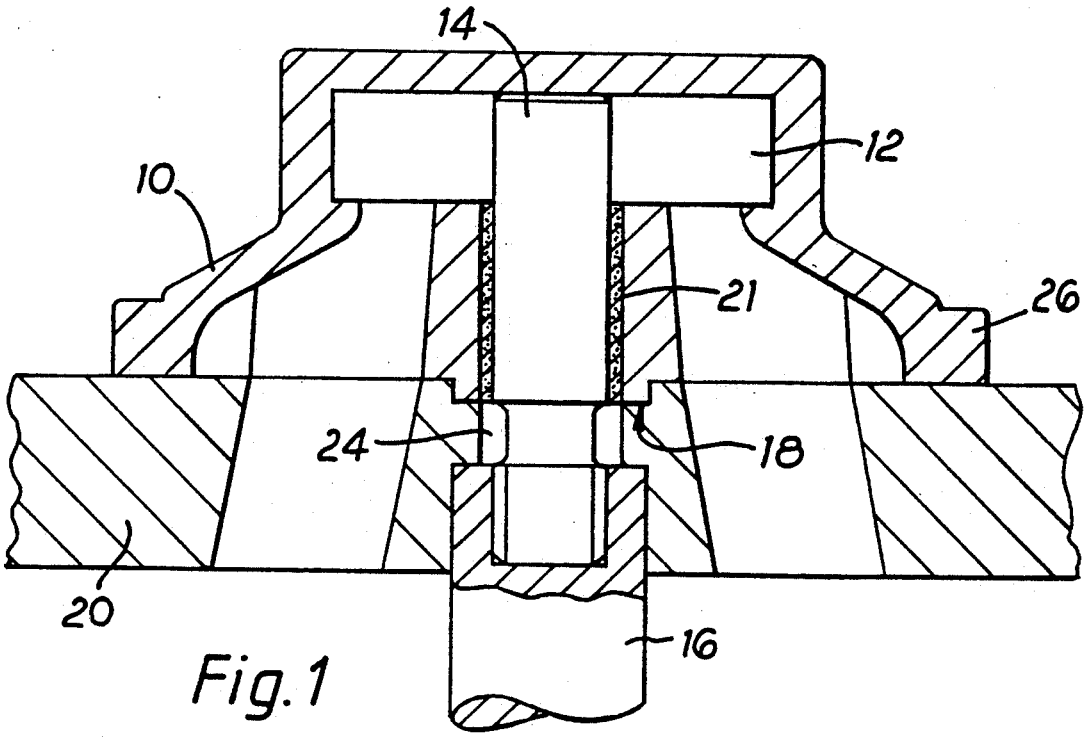
Fig. 1 (PRIOR ART)
FIG. 1 is a diagrammatic sectional elevation showing the prior art arrangement.

Turning first to FIG. 1, a typical prior art pump comprises a body 10 housing a gerotor pump set 12, and the body is provided with appropriate inlet and outlet ports for the lubricant to be circulated by the pump. The pump has a driven shaft 14 keyed or like angularly fast with a drive shaft 16 which may be the crankshaft of the engine, and the shaft is journalled in bush 21 in the body.

In order to align the pump with the end of shaft 16, a recess or shoulder 18 which ia precisely concentric with the shaft axis is machined in the engine block 20. The pump body has a complementary stepped face which is likewise precisely concentric to the shaft axis. In addition the pump body is provided with holes for bolts and the block 20 is likewise provided with screw tapped apertures to receive those bolts.

Figure 2:
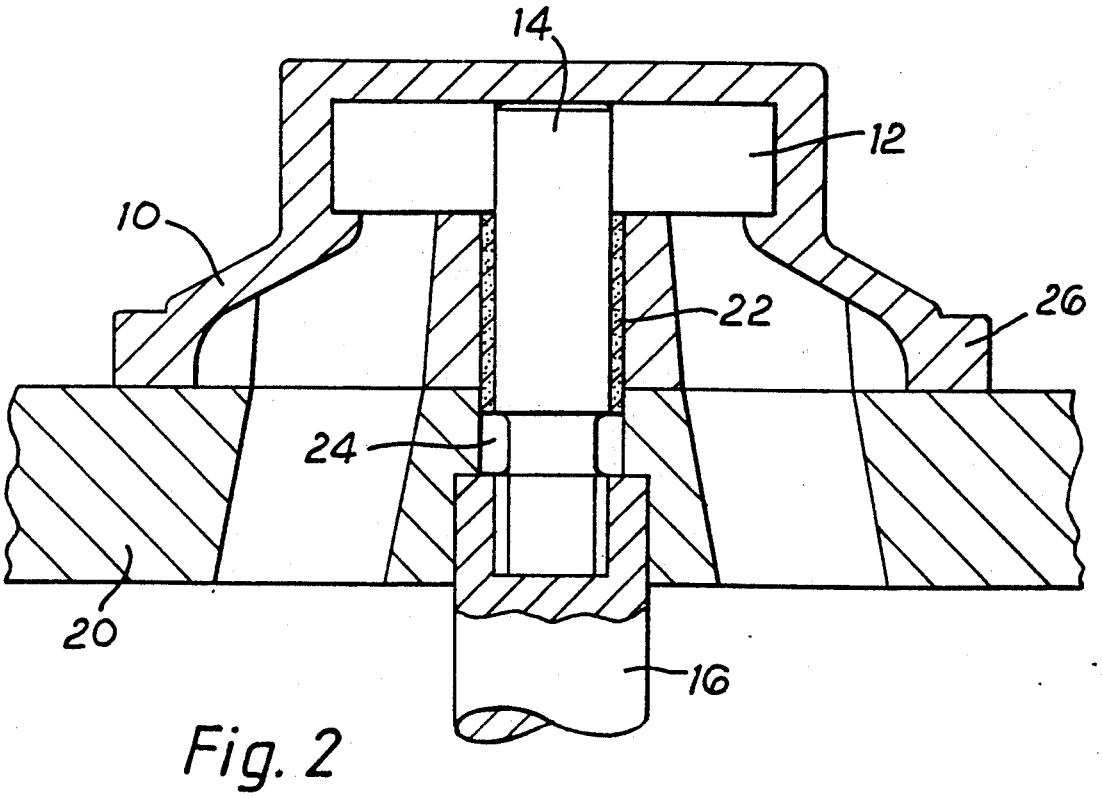
FIG. 2 is similar to FIG. 1 but showing the invention.

Turning now to the invention in FIG. 2, the pump body is made planar instead of being stepped, and the part 20 is likewise planar. The pump drive shaft 14 now has a bush 22 which is received in the bore 24 in order to align the shaft 14 with the shaft 16. The pump body is therefore self locating. It may be clamped in place by bolts passing through enlarged apertures in the pump body flange 26 and into screw-tapped apertures in the part 20 in the usual way.

I claim:

1. The combination of an internal combustion engine and a pump wherein said engine comprises a block having a first bore therein and a drive shaft journalled in said block and axially aligned with said bore; and wherein said pump comprises a housing having a second bore therein, a driven shaft in said second bore, and a bush having a length greater than that of said second bore journalling said driven shaft in said second bore, said bush extending the full length of said second bore and into the first bore and establishing a coaxial relationship among said first and second bores, said drive shaft, said driven shaft, and said bush; and drive transmitting means coupling said drive shaft and said driven shaft for rotating the latter in response to rotation of said drive shaft, said block and said housing having planar, unstepped surfaces sealingly seated on one another whereby the said coaxial relationship is established solely by said bush.

2. The combination set forth in claim 1 wherein said bush is coated with low friction material.

3. The combination set forth in claim 1 wherein said bush is impregnated with low friction material.

4. The combination set forth in claim 1 wherein said pump housing is clamped to said block following the establishment of said coaxial relationship.

* * * * *